US006252556B1

(12) United States Patent
Ito et al.

(10) Patent No.: US 6,252,556 B1
(45) **Date of Patent: *Jun. 26, 2001**

(54) MICROWAVE PLANAR ARRAY ANTENNA

(75) Inventors: Fumihiro Ito, Tokyo; Keiji Fukuzawa, Chiba; Shinobu Tsurumaru, Kanagawa, all of (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 07/978,030

(22) Filed: Nov. 18, 1992

Related U.S. Application Data

(63) Continuation of application No. 07/606,901, filed on Oct. 31, 1990, now abandoned.

(30) Foreign Application Priority Data

Nov. 8, 1989 (JP) ..... 1-290921

(51) Int. Cl.[7] ..... H01Q 1/38; H01Q 13/08
(52) U.S. Cl. ..... 343/770; 343/778; 343/700 MS
(58) Field of Search ..... 343/700 MS, 778, 343/829, 846, 770; H01Q 1/38, 13/08, 21/00, 21/06, 21/24

(56) References Cited

U.S. PATENT DOCUMENTS

| | | | | |
|---|---|---|---|---|
| 4,486,758 | * | 12/1984 | de Ronde | 343/700 MS |
| 4,614,947 | * | 9/1986 | Rammos | 343/778 |
| 4,888,597 | * | 12/1989 | Rebiez et al. | 343/778 |
| 5,061,943 | * | 10/1991 | Rammos | 343/778 |
| 5,119,107 | * | 6/1992 | Wildey et al. | 343/778 |

FOREIGN PATENT DOCUMENTS

| | | |
|---|---|---|
| 0 301 580 | 2/1989 | (EP) . |
| 0 317 414 | 5/1989 | (EP) . |
| 0 384 780 | 8/1990 | (EP) . |

OTHER PUBLICATIONS

"Planar Antennas For Satellite Reception", IEEE Trans. on Broadcasting 34 Dec., (1988) No. 4, pp. 457–464.

* cited by examiner

*Primary Examiner*—Michael C. Wimer
(74) *Attorney, Agent, or Firm*—Sonnenschein, Nath & Rosenthal

(57) ABSTRACT

A planar array antenna is comprised of an upper plate having a plurality of holes, a lower plate, and a circuit board having printed patterns of a plurality of array elements and located between the upper plate and the lower plate, wherein the lower plate has concave regions formed at positions corresponding to the positions of the plurality of holes of the upper plate.

11 Claims, 5 Drawing Sheets

MICROWAVE PLANAR ARRAY ANTENNA

This is a continuation, of application Ser. No. 07/606, 901, filed Oct. 31, 1990, abandoned.

BACKGROUND OF THE INVENTION

1. Field of the Invention

The present invention relates to a planar array type microwave antenna for use in, for example, receiving satellite broadcasts.

2. Description of the Prior Art

In a suspended line feed type planar antenna in which a substrate is sandwiched between metal or metallized plastics plates having a number of openings forming parts of radiation elements, a circular polarized wave planar array antenna has been proposed. In this previously-proposed antenna, a pair of excitation probes which are perpendicular to each other, the number of which corresponds to the number of openings, are formed on a common plane and signals fed to the pair of excitation probes are mixed in phase within the suspended line.

Thus, the above-mentioned planar antenna can be reduced in thickness as compared with the existing one, and also its mechanical configuration can be simplified. Further, an inexpensive substrate now available on the market can be employed for high frequency use, achieving antenna gain equal to or greater than that of a planar antenna using an expensive microstrip line substrate.

The suspended line achieves such advantages in that it forms a low loss line as a circuit for feeding the planar antenna, and also in that it can be formed on an inexpensive film shaped substrate, and so on. Further, since this conventional planar antenna utilizes a circular or rectangular waveguide opening element as a radiation element, it is possible to construct an array antenna which has a small gain deviation over a relatively wide frequency range.

A so-called patch-slot array antenna has been proposed, which effectively utilizes features of the suspended line and thin radiation elements to provide high efficiency and wide bandwidth. Also, this type of array antenna can be reduced in thickness and weight (see our U.S. patent application Ser. No. 223,781 filed Jul. 25, 1988), now U.S. Pat. No. 4,087, 920.

In the suspended line feed-type planar array antenna in which the substrate is sandwiched between the pair of metal or metallized plastics plates, a number of resonance type printed patch radiators are formed on the substrate at positions corresponding to openings formed through one of the metal or metallized plastics plates.

However, the planar array antenna described in U.S. Pat. No. 5,087,920 has formed around a number of resonance type printed patch radiators thereof flanges as supporting portions so that difficult cutting work cannot be avoided, which makes the efficient mass-production of the antenna impossible. Also, this makes the antenna expensive.

In order to solve the aforenoted problems, a suspended line feed type planar array antenna has been proposed (see our U.S. patent application Ser. No. 258,728), now U.S. Pat. No. 4,990,926, in which a substrate is sandwiched between an upper plate having a number of openings and a lower plate opposing the upper plate. Specifically, in this previously-proposed suspended line feed type planar array antenna, protrusions are formed on the upper and lower plates at their corresponding positions by a press-treatment and the substrate is supported by these protrusions. According to this antenna, difficult cutting work is not needed and only the simple press-treatment is required, which permits the efficient mass production. This can also make the antenna inexpensive.

FIG. 1 shows a circuit arrangement in which a plurality of circular polarized wave radiation elements are fed in phase by a suspended line, forming the array. In that case, the circular polarized wave radiation elements are such as described in U.S. Pat. No. 258,728. The solid line in FIG. 2 illustrates a portion cut through the line II—II in FIG. 1. The broken-line portion of FIG. 2 illustrates such a condition that the second metal plate 2 covers the top of the arrangement shown in FIG. 1.

A plurality of protrusions 11 are formed on the first metal plate 1 between the conductive foils 8 and the suspended lines in order to support the substrate 3. The protrusion 11 is further provided on the first metal plate 1 around the outer peripheral portion of the planar array antenna, as shown. Other portions of the first metal plate 1 form cavity portions 7. There is then the substantial risk that the outputs from the plurality of conductive foils 8 may be delivered through the same cavity portion 7 and hence the above-mentioned outputs will be coupled with each other. If, however, the spacing between the neighboring conductive foils 8 and the spacing between the upper and lower walls of the cavity portion 7 are properly selected, necessary isolation can be established, thus eliminating the above-mentioned risk of the mutual coupling. Since the electric lines of force are concentrated on the upper and lower walls of each cavity portion 7, the electric field along the substrate 3 supporting the conductive foils 8 is substantially removed, thus lowering the dielectric loss. As a result, the transmission loss of the line is reduced.

The protrusions and the cavity portions are also formed on the second metal plate 2 in correspondence with those of the first metal plate. More specifically, protrusions 12 are formed on the second metal plate 2 around the slots 5 bored therethrough and around the periphery of the feeding portion positions between the conductive foils 8 and the suspended lines to support the substrate 3, while other portions between the protrusions form the cavity portions 7.

Since the substrate 3 is uniformly supported by the protrusions 11 and 12 provided as described above, the substrate 3 can be prevented from being warped downwardly. In addition, since the top and bottom metal plates 1 and 2 are brought in face-to-face contact with the substrate 3 around the respective radiation elements, the feeding portions and so on similarly as described above, it is possible to prevent any resonance at a particular frequency from being caused.

Referring to FIG. 1, 16 radiation elements are arranged in groups of four, to provide four radiation element groups $G_1$ to $G_4$. A junction P, of the suspended lines in each group is displaced from the center point of the group by a length of $\lambda g/2$ ($\lambda g$ represents the line wavelength at the center frequency). Junctions $P_2$ and $P_3$ in the suspended lines feeding two radiation elements in each group are connected with a displacement of each of $\lambda g/P_4$ from the center point between these two. Accordingly, in each group of the radiation elements, the lower-right-hand radiation element is displaced in phase from the upper-right-hand radiation element by 90 degrees, the lower-left-hand radiation element is displaced therefrom by 180 degrees and the upper-lefthand radiation element is displaced therefrom by 270 degrees, respectively, which results in the axial ratio being improved. In other words the axial ratio can be improved to be wide by varying the spatial phase and the phase of the feeding line. In view of another aspect, any two of vertically or horizontally neighboring patch radiators have slit directions 90 degrees apart from each other.

The junction P in each group and the junctions $P_4$ to $P_6$ in the suspended lines feeding the respective, groups are coupled to one another in such a fashion that they are distant from the feeding point 10 of a feeding portion 9 by an equal distance. That is, it is possible to obtain various kinds of directivity characteristics, by changing the feeding phase and the power distribution ratio, by changing the positions of the junction P, and the junctions $P_4$ to $P_6$. In other words, the feeding phase is changed by varying the distances from the feeding point 10 to the junctions P, and to the junctions $P_4$ to $P_6$, and the amplitude is varied by varying the impedance ratio by increasing or decreasing the thickness of the lines forming the various branches of the suspended line, whereby the directivity characteristics can be varied in a wide variety of range.

According to the method in which the substrate is supported by a number of protrusions as shown in FIG. 1, the protrusions are formed on the pair of metal plates between the conductive foils, and the patch slot type resonance print elements deposited on the substrate are coaxial with the slots and the suspended lines, so that no problem will arise in a portion where the protrusions are concentrated to some degree. However, in a portion where the protrusions are formed poorly, the substrate can not be uniformly supported at its intermediate portion. Thus, the positional displacement of the substrate occurs in the up and down direction partly in the upper to lower direction. In worst cases, the substrate is slackened. There is then the substantial risk that the printed radiation element will touch the metal plate. As a result, there is the substantial disadvantage that deterioration of antenna characteristic such as the decrease of antenna gain or the like will occur.

Furthermore, since a number of protrusions have to be formed in correspondence on the pair of plates, the number of manufacturing-process for manufacturing the plates is increased and the productivity is relatively poor.

Therefore, in a suspended line feed type planar antenna in which a substrate is sandwiched between an upper plate having a number of openings and a lower plate opposing to the upper plate, spacers or distance pieces having a number of corresponding openings are provided between the upper plate and the substrate and between the substrate and the lower plate, respectively thereby supporting the substrate. Thus, the substrate can be positively supported at the intermediate portion between the upper and lower plates with a uniform distance therebetween. As a result, the protrusions formed on the upper and lower plates can be reduced considerably, which makes the manufacturing process of the upper and lower plates simple and which can increase the productivity (see Japanese Patent Application No. 63-199513).

FIG. 3 shows in cross section a structure of planar array antenna described in Japanese Patent Application No. 63-199513. In FIG. 3, reference numeral 20 designates a rear cover, 21 a lower plate, 22 a distance piece or spacer, 23 a film substrate on which a number of resonance type printed patch radiators (radiation elements) 23' are printed, 24 a distance piece or spacer, 25 an upper plate, 26 a support cushion made of low foaming styrol and 27 a radome. In that case, the rear cover 20 is 3 mm in thickness, the upper and lower plates 21, 25 and distance pieces 22, 24 are 1 mm in thickness, respectively, the support cushion 26 is 12 to 14 mm in thickness, and the radome 27 is 1 mm in thickness. The entire thickness of this planar array antenna is about 20 to 22 mm.

This previously-proposed planar array antenna shown in FIG. 3 can not avoid the following shortcomings and disadvantages:

(1) Since the distance between the radiation element 23, and the lower plate 21 provided as the ground plate is 1 mm, the change of element impedance and the ratio in which the operational gain is changed are made large due to slackening of the film substrate 23.

(2) Since the distance between the lower plate 21 and the upper plate 25 is 2 mm, the feed line loss is large. For example, when the line width was 1.5 mm at the frequency of 12 GHz and the characteristic impedance $Z_0$ of line was selected to be 76Ω, feed line loss was 1.6 to 1.8 dB/m.

(3) The element gain is small (about 6.5 dB).

(4) The impedance matching band width of elements is narrow.

(5) Since the resonance type printed patch radiator is of the type for feeding one feed point, the circularly polarized wave band is narrow and the pair of four elements must be fed with a phase difference therebetween.

(6) Because of the disadvantages (4) and (5), the excitation balance of elements can not be made without difficulty.

OBJECTS AND SUMMARY OF THE INVENTION

Accordingly, it is an object of the present invention to provide an improved microwave planar array antenna which can substantially eliminate the aforenoted shortcomings and disadvantages encountered with the prior art.

More specifically, it is an object of the present invention to provide a microwave planar array antenna in which various characteristics such as element gain, impedance matching band width of element, excitation balance or the like can be improved while the decreased thickness thereof can be maintained.

Another object of the present invention is to provide a microwave planar array antenna suitable for use in, for example, receiving a microwave transmission such as satellite broadcasts.

As an aspect of the present invention, a planar array antenna is comprised of an upper plate having a plurality of holes, a lower plate, and a circuit board having drawn patterns of a plurality of array elements and being located between the upper plate and the lower plate, wherein the lower plate has concave regions formed at corresponding positions of the plurality of holes of the upper plate.

The preceding, and other objects, features and advantages of the present invention will become apparent in the following detailed description of illustrative embodiments to be read in conjunction with the accompanying drawings.

DETAILED DESCRIPTION OF THE PREFERRED EMBODIMENTS

The present invention will now be described in detail with reference to FIGS. 5 to 9.

Figure 5:
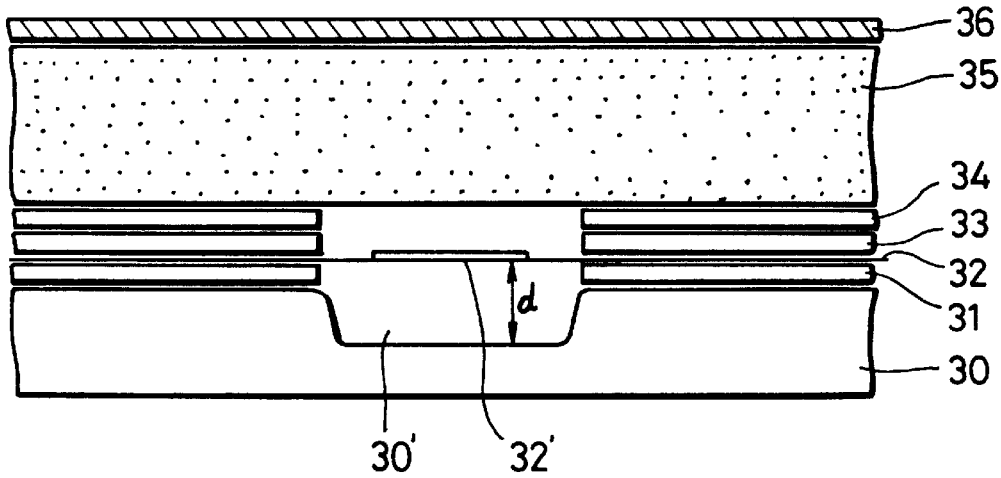
FIG. 5 is a cross-sectional view illustrating a first embodiment of a planar array antenna according to the present invention.

FIG. 5 shows in cross-section a structure of the first embodiment of the planar array antenna according to the present invention.

In FIG. 5, reference numeral 30 designates a lower plate made of a metal or metallized plastics plate, 31 a spacer or distance piece made of dielectric high foaming material having low dielectric ratio and low loss such as polyethylene, polypropylene, polystyrol or the like, and 32 a film substrate. On the film substrate 32, there are formed a number of resonance type printed patch radiators (radiation elements) 32, shown in FIG. 6 by a printing-process.

Figure 1:
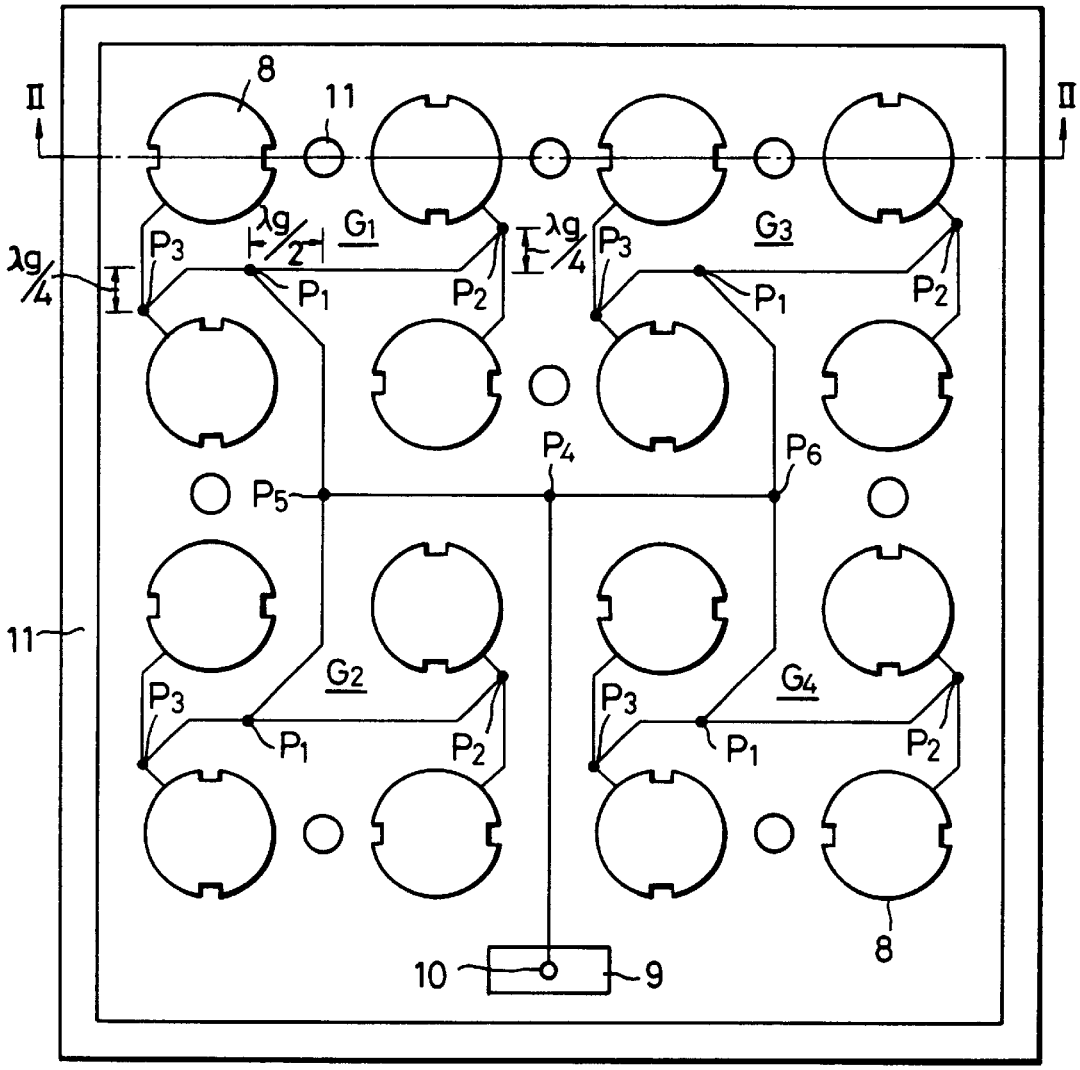
FIG. 1 (PRIOR ART)
FIG. 1 is a plan view of a feed circuit of a conventional planar array antenna.
Figure 6:
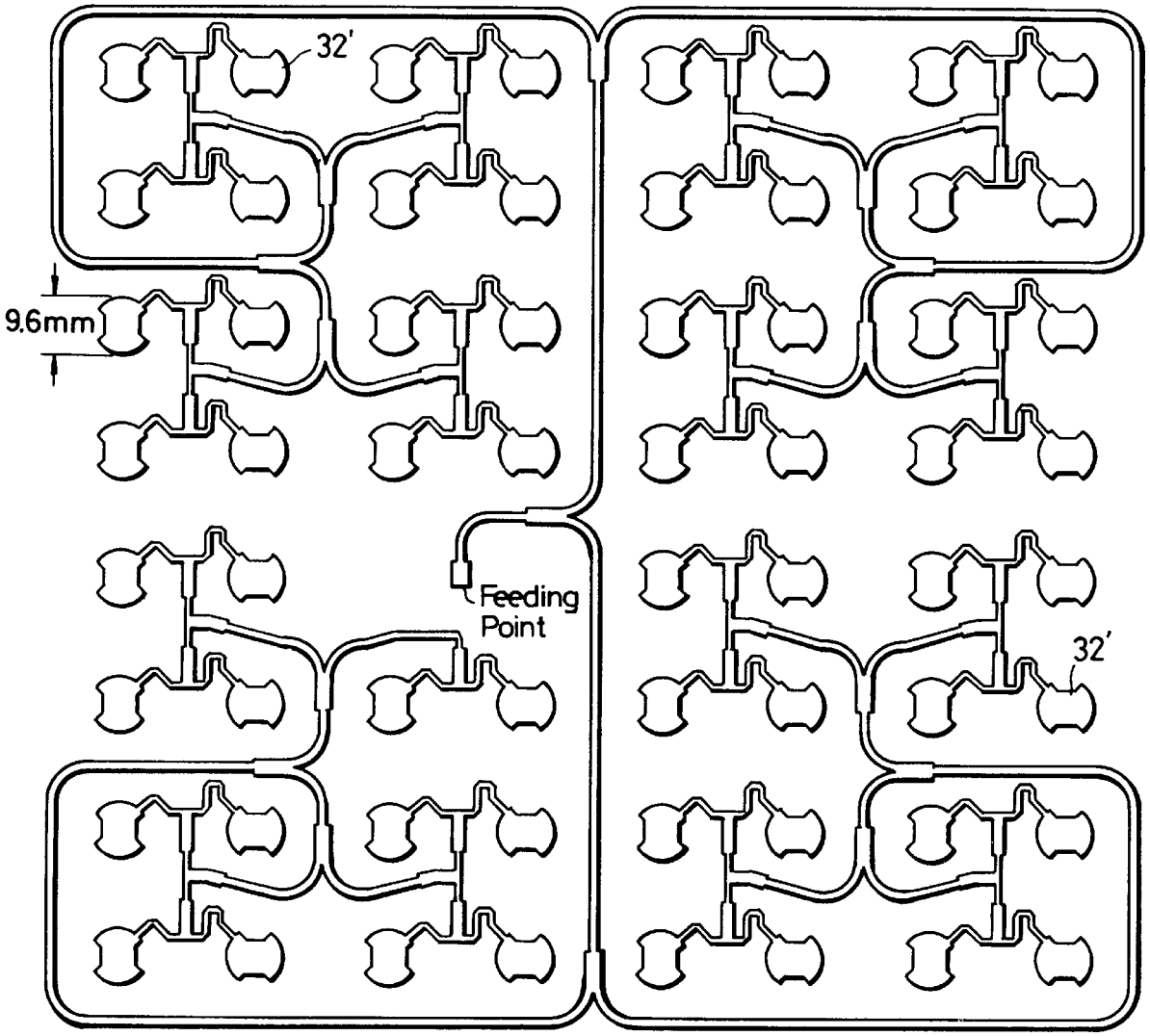
FIG. 6 is a plan view of a feed circuit of the planar array antenna of the present invention shown in FIG. 5.

FIG. 6 shows a circuit arrangement of a feeding circuit by which a plurality of circular polarized radiation elements forming an array are co-phase fed by suspended lines. While the diameter of the radiation element of FIG. 1 is selected to be 12 mm, the diameter of the radiation element 32' , of the embodiment of FIG. 6 is 9.6 mm. Further, in this embodiment, the radiation elements 32 are arranged in pairs, with the members of the pairs oriented at a right angle to each other, are fed at different phases so that parameters are reduced thereby. From a characteristic standpoint, this is advantageous in that excitation balance of elements can be achieved with ease and so on.

Turning back to FIG. 5, reference numeral 33 designates a spacer or distance piece similar to the distance piece 31, 34 an upper plate of thin plate type configuration formed of a metal or metallized plastics plate, 35 a support cushion made of, for example, low foaming styrol and 36 a radome.

A number of openings are formed through the distance pieces 31, 33 and the upper plate 34 in correspondence with a number of radiation elements 32', similarly to the prior art.

In this embodiment, concave regions 30', are formed on the lower plate 30 in alignment with a number of openings formed through the upper plate 34. That is, the height from the radiation element 32' to the lower plate 30 is increased to provide a predetermined height d and this predetermined height d is selected to be, for example, 5 mm.

Figure 2:
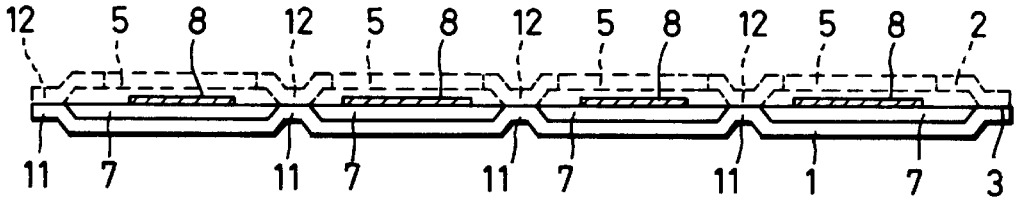
FIG. 2 (PRIOR ART)
FIG. 2 is a cross-sectional view taken along line II—II in FIG. 1, and illustrating the conventional planar array antenna.
Figure 3:
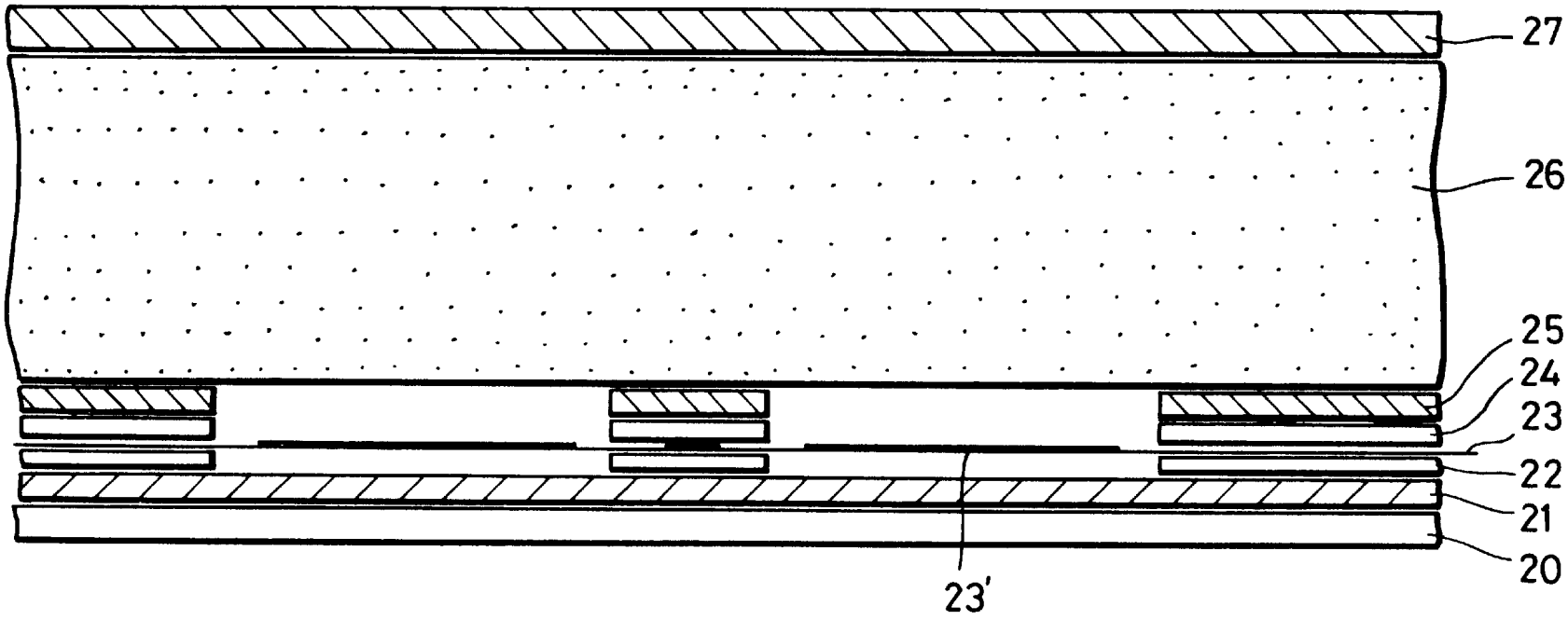
FIG. 3 (PRIOR ART)
FIG. 3 is a cross-sectional view of another conventional planar array antenna.
Figure 4:
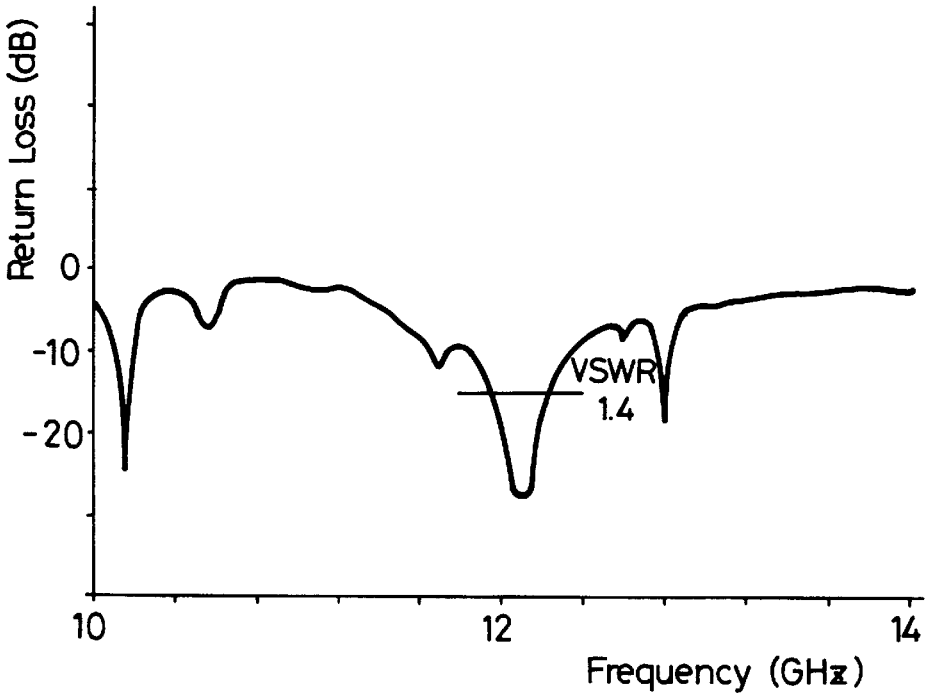
FIG. 4 (PRIOR ART)
FIG. 4 is a graph of a return loss versus frequency characteristic of the conventional planar array antenna.
Figure 9:
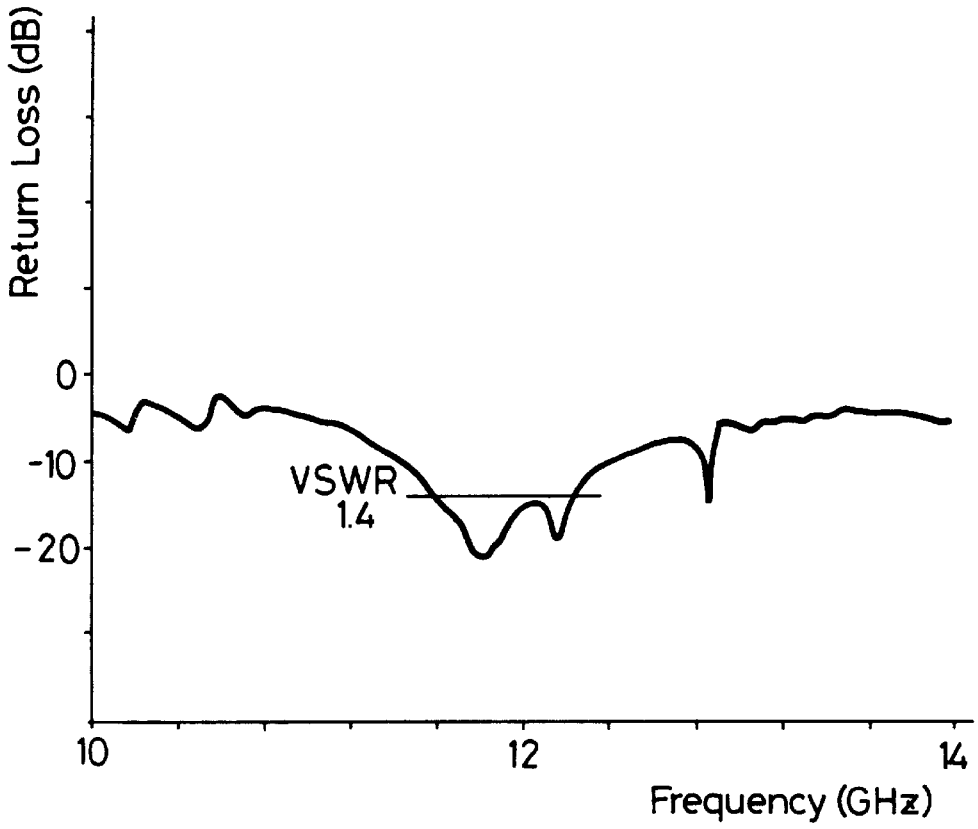
FIG. 9 is a graph of return loss versus frequency characteristics of the planar array antenna of the present invention.

In the example of the prior art shown in FIG. 2, the dimension corresponding to the predetermined height d is 1 mm, and the band width in which the voltage standing wave ratio (i.e., VSWR) is kept less than 1.4 is about 300 MHz in the region of the 12 GHz band as shown in FIG. 4. However, with the predetermined height d selected to be 5 mm, as in this embodiment, the band width in which the voltage standing wave ratio is kept less than 1.4 is about 700 MHz in the vicinity of the 12 GHz band, as shown in FIG. 9, which can provide a relatively wide gain. Thus, deterioration of excitation balance of radiation elements due to distribution or the like can be reduced, the change of impedance is reduced, the change of characteristic due to slackening of substrate can also be reduced. In addition, the gain of radiation elements can be increased. In other words, by selecting the height d between the radiation element 32, and the lower plate 30 to be 5 mm, it is possible to remove the aforementioned defects (1) to (4) and (6) of the prior art, as listed above.

Figure 7:
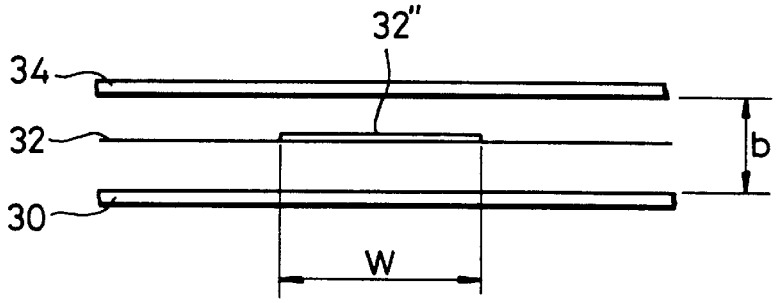
FIG. 7 is schematic diagram showing a main portion of the first embodiment of the planar array antenna according to the present invention.

Further, in accordance with this embodiment, as shown in FIG. 7, a spacing b is maintained between the lower plate and the upper plate 34, on opposite sides of the line (feeder) 32", and this spacing is selected to be 4 mm while it is 2 mm in the prior art.

More specifically, while the feed line loss of the prior art is in a range of from 1.6 to 1.8 dB/m, if the line width W of the line 32" is selected to be 1.5 mm at 12 GHz, the characteristic impedance $Z_0$ of the line is selected as about 111Ω and the spacing b between the lower plate 30 and the upper plate 34 is selected to be 4 mm as in this embodiment, the feed line loss can be improved about 0.9 to 1.1 dB/m. The reason for this is that dielectric loss of the film substrate is reduced by increasing the spacing b. Although the coupling amount is increased and a higher degree mode tends to occur, these defects can be removed by selecting proper parameters.

By increasing the spacing b between the lower plate 30 and the upper plate 34 relative to the feed line 32', as compared with the prior art, it is possible to solve the aforementioned problem (5) of the prior art, as listed on page 7.

Furthermore, in this embodiment, the element gain can be increased by properly selecting the thickness of the radome 36. According to the experimental results, when the thickness of the radome 36 is selected to be 3 mm, the element gain can be increased by +2.5 to 2.9 dB as compared with the prior art, which can solve the aforementioned problem (1) of the prior art, as listed on page 7.

When the thicknesses of the respective portions in FIG. 5 are examined, the thickness of the lower plate 30 is 5 mm, the thicknesses of the spacers or distance pieces 31 and 33 are 2 mm, the thickness of the upper plate 34 is 1 mm, the thickness of the support cushion 35 is 12 to 14 mm and the thickness of the radome 36 is 3 mm, respectively. The entire thickness becomes 25 to 27 mm, which is adequate to provide the thin planar array antenna, although the entire thickness is increased a little as compared with the prior art.

Figure 8:
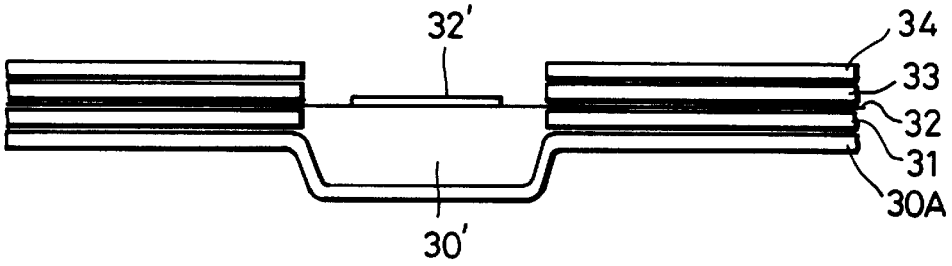
FIG. 8 is a schematic diagram showing a main portion of a second embodiment of the planar array antenna according to the present invention.

FIG. 8 shows a second embodiment of the present invention. While in the first embodiment of FIG. 5 the lower plate 30' is thick and the concave regions 30 are formed thereon by a cutting-process or the like, in the arrangement of FIG. 8, the whole of a lower plate 30A is molded as a thin planar plate having the concave regions 30 molded therewith by a press-molding process. In the case of FIG. 5, the lower plate 30 is thick so that a rear cover is not needed. However, in the case of FIG. 8, a rear cover may be attached to the lower plate 30, if necessary.

As described above, according to the present invention, since the upper plate is formed as a flat thin plate and the concave regions are formed on the lower plate in alignment with a number of holes of the upper plate, various characteristics such as the element gain, the impedance matching band width of element, the excitation balance or the like can be improved while maintaining the decreased thickness of the planar array antenna.

Having described preferred embodiments of the invention with reference to the accompanying drawings, it is to be understood that the invention is not limited to those precise embodiments and that various changes and modifications thereof could be effected by one skilled in the art without departing from the spirit or scope of the novel concepts of the invention as defined in the appended claims.

We claim as our invention:

1. A planar array antenna comprising:

an upper plate having a plurality of holes;

a lower plate;

a plurality of resonance elements formed between the upper plate and the lower plate at locations corresponding to the plurality of holes, wherein said plurality of resonance elements exist in a single layer on a substrate;

an upper spacer layer between the resonance elements and the upper plate with no intervening layers, said upper spacer layer having holes corresponding to the plurality of holes in the upper plate;

a lower spacer layer between the resonance elements and the lower plate with no intervening layers; and wherein the lower plate has a substantially planar surface having a first distance to the upper plate and a plurality of depressed regions in the planar surface at locations corresponding to the locations of the plurality of holes having a surface with a second distance to the upper plate wherein the first distance is less than the second distance and there is a continuous metal surface from the planar surface to the surface of the depressed regions.

2. The planar array antenna of claim 1, wherein the lower plate is thicker than the upper plate.

3. The planar array antenna of claim 1, wherein the depressed regions are press formed into the lower plate.

4. The planar array antenna of claim 1, wherein the depressed regions are machined into the lower plate.

5. The planar array antenna of claim 1, wherein said upper plate is one of metal or metallized plastic; wherein said lower plate is one of metal or metallized plastic; and wherein said upper spacer layer and said lower spacer layer are a dielectric material.

6. The planar array antenna of claim 1, wherein said upper spacer layer is for providing a predetermined distance between said upper plate and said resonance elements; and wherein said lower spacer layer is for providing a predetermined distance between said resonance elements and said lower plate.

7. The planar array antenna of claim 5, wherein said upper spacer layer is for providing a predetermined distance between said upper plate and said resonance elements; and wherein said lower spacer layer is for providing a predetermined distance between said resonance elements and said lower plate.

8. A planar array antenna comprising:

an upper plate having a plurality of holes, said upper plate being one of metal or metallized plastic;

a lower plate being one of metal or metallized plastic;

a plurality of resonance elements formed between the upper plate and the lower plate at locations corresponding to the plurality of holes, wherein said plurality of resonance elements exist in a single layer on a substrate;

an upper spacer layer between the resonance elements and the upper plate having holes corresponding to the plurality of holes in the upper plate, said upper spacer layer being a dielectric material;

a lower spacer layer between the resonance elements and the lower plate, said lower spacer layer being a dielectric material; and wherein the lower plate has a substantially planar surface having a first distance to the upper plate and a plurality of depressed regions in the planar surface at locations corresponding to the locations of the plurality of holes having a surface with a second distance to the upper plate wherein the first distance is less than the second distance and there is a continuous metal surface from the planar surface to the surface of the depressed regions.

9. The planar array antenna of claim 8, wherein the lower plate is thicker than the upper plate.

10. The planar array antenna of claim 8, wherein the depressed regions are press formed into the lower plate.

11. The planar array antenna of claim 8, wherein the depressed regions are machined into the lower plate.

* * * * *